United States Patent [19]

Garofalo

[11] 4,441,142

[45] Apr. 3, 1984

[54] UNDERWATER FLASHLIGHT

[75] Inventor: Giovanni Garofalo, Rapallo, Italy

[73] Assignee: AMF Inc., White Plains, N.Y.

[21] Appl. No.: 399,566

[22] Filed: Jul. 19, 1982

[30] Foreign Application Priority Data

Jul. 21, 1981 [IT] Italy ..... 15185/81[U]

[51] Int. Cl.[3] ..... F21L 7/00

[52] U.S. Cl. ..... 362/158; 362/203; 362/205; 362/206; 200/60

[58] Field of Search ..... 362/203, 201, 205, 158, 362/206; 200/60, 61.52

[56] References Cited

U.S. PATENT DOCUMENTS 1,375,586 4/1921 Graves ..... 200/60

2,736,793 2/1956 Raymond ..... 362/203

4,306,277 12/1981 Bodde ..... 362/203

*Primary Examiner*—Stephen J. Lechert, Jr.

*Assistant Examiner*—Howard J. Locker

*Attorney, Agent, or Firm*—David E. Dougherty; Walter R. Pfluger, Jr.

[57] ABSTRACT

The battery assembly is housed in the casing of the flashlight so as to be axially slidable therein, whereby the displacement of said assembly in one direction closes the electrical circuit comprising the bulb, and the displacement in the opposite direction opens said circuit. A pushbutton radially extends from the flashlight casing. The said pushbutton is provided with a cam-shaped portion cooperating with an axially slidable cam follower to transmit the axial displacement to the battery assembly.

3 Claims, 1 Drawing Figure

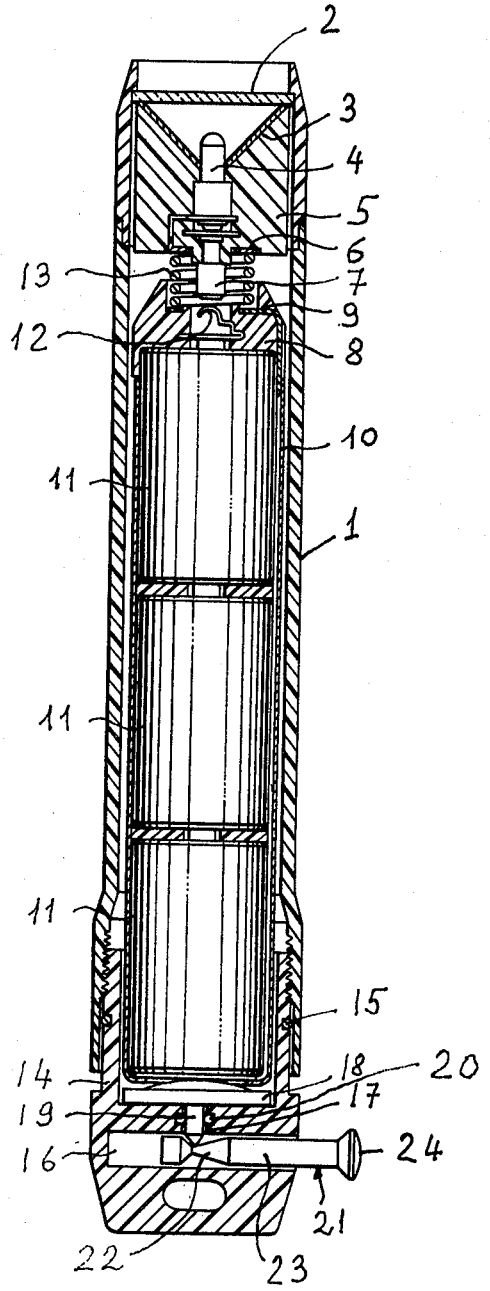
2
3
4
5
6
7
9
8
13
12
10
11
1
11
11
15
14
18
20
17
19
16
24
21
22
23

UNDERWATER FLASHLIGHT

BACKGROUND AND SUMMARY OF THE INVENTION

This invention relates to an underwater flashlight, such as is used in SCUBA activities, of the type wherein the battery assembly is housed in the casing of the flashlight so as to be axially slidable therein, whereby the displacement of the battery assembly in one direction, against the action of a spring, closes the electrical circuit comprising the bulb, and the displacement in the opposite direction opens said circuit, so as to turn the light either on or off respectively.

Several devices to effect said displacement in underwater flashlights are known. All these devices are based on the screwing rotation of an end member of the flashlight which presents difficulties when something is carried undewater in one hand and it is desired to turn on the light in the other hand.

The object of this invention is to provide a flashlight of the above type, having a device for causing the displacement of the battery assembly by actuating a pin radially protruding from the body of the flashlight, rather than by a screwing rotation.

This actuation of the switch-pin can be easily effected by depressing it with the palm of the same hand grasping the flashlight.

Upon releasing the depressing action, the device is automatically moved back to the open-circuit position by the action of a spring.

Of course, this pushbutton-type control can be associated with a screw-type control which locks the flashlight in the on position until it is unscrewed.

BRIEF DESCRIPTION OF THE DRAWING

Further characteristics and advantages of this invention will be more apparent from the following description of a preferred embodiment thereof, made with reference to the accompanying drawing showing an axial sectional view of the flashlight according to the invention.

DESCRIPTION OF THE PREFERRED EMBODIMENT OF THE INVENTION

With reference to the drawing, the flashlight comprises a tubular casing 1 closed at one end by a transparent lens 2 and a parabolic reflector 3 in the focus of which a bulb 4 is located by a lamp-holder block 5. One terminal of the bulb 4 is electrically connected to a ring 6 secured to the inner end of the lamp-holder block 5, and the other terminal is electrically connected to a central pin 7.

Located within the casing 1 is a battery-holder comprising a head member 8 having secured thereto a contact ring 9 which is electrically connected to a conducting strip 10 extending along the sides of the serially-assembled batteries 11 down to the bottom of the last battery of the assembly; and the central contact 12 contacting the central pin terminal of the first battery of the assembly. A coil spring 13 is arranged between the rings 6 and 9.

The bottom end of the casing 1 is closed by a screw-plug 14, a suitable sealing ring 15 being seated therebetween.

The screw-plug 14 comprises a radial blind hole 16 and an axial through hole 17 connecting the interior of the casing 1 to the radial hole 16. A small tray 18 rests on the bottom of the plug 14 and is provided with a short stem 19 protruding through said hole 17, a sealing ring 20 being interposed therebetween. The free end of the stem 19 projects from the hole 16 and is of suitable frusto-conical shape. Mounted in the radial hole 16 is a control pin 21 comprising an intermediate portion 22 of double-conical shape, a cylindrical portion 23 and an outer button 24.

The double-conical portion 22 cammingly co-operates with the free end of said stem 19 of the tray 18.

The operation of this flashlight is apparent. By depressing the button 24, the stem 19 is pushed inwards, whereby the tray 18 pushes the assembly of the batteries 11 to the closed position of the electrical circuit comprising the batteries 11 and the bulb 4, against the action of the spring 13. Upon release of the depressing action on the button 24, the spring 13 pushes the batteries back to the open-circuit position.

On the other hand, if the circuit is to be kept closed permanently, the screw-plug 14 cam be screwed down completely.

Obviously, the invention is not limited to the embodiment herein shown and described, but embraces all changes and modifications within the broadest scope of the inventive principle.

I claim:

1. In a flashlight of the type wherein spring loaded battery means are mounted in a casing assembly for displacement along the longitudinal axis to close the normally open electrical bulb-battery circuit in one direction and the displacement in the opposite direction opens said circuit, wherein the improvement comprises:

plug means fastened to and closing the casing assembly, said plug means having an aperture through one side transverse to said casing axis and an axial aperture connecting the transverse aperture with the casing interior;

shaft means extending through the transverse aperture for displacement transverse to said axis and having a camming portion within the plug and an operating portion outside of the plug;

cam follower means extending from the shaft means through the axial aperture to the battery means and co-operating with the shaft means camming portion to transmit shaft transverse displacement to battery means axial displacement whereby shaft displacement in one direction connects the bulb-battery circuit and displacement in the opposite direction disconnects it; and means for preventing leakage into the casing assembly.

2. An improved flashlight according to claim 1 in which the battery means include: conducting shell means around the battery portion for connecting a bulb terminal to a battery terminal, having an aperture at one end for passage of the cam follower means to the battery means.

3. An improved flashlight according to claim 2 in which the cam follower surface contacting the battery means is shaped to also contact the conducting shell means.

* * * * *